United States Patent [19]

Leddy

[11] 4,068,647

[45] Jan. 17, 1978

[54] AUTOMOTIVE IGNITION TOOL

[76] Inventor: Jerome R. Leddy, 322-16th St., Seal Beach, Calif. 90740

[21] Appl. No.: 610,111

[22] Filed: Sept. 4, 1975

[51] Int. Cl.[2] ..... F02B 77/00

[52] U.S. Cl. ..... 123/198 R; 174/35 SM

[58] Field of Search ..... 123/148 S, 143 C, 169 PH, 123/198 R, 1 R, 198 D, 169 PA, 169 CM, 169 CA, 169 E; 81/1, 3 R; 174/35 R, 35 C, 35 SM, 35 MS, 36, 5 SG; 2/2

[56] References Cited

U.S. PATENT DOCUMENTS

| | | | |
|---|---|---|---|
| 1,956,805 | 5/1934 | Meyer | 123/169 PH |
| 2,056,739 | 10/1936 | Rabezzana | 174/35 SM X |
| 2,149,027 | 2/1939 | Meredith | 123/169 PH |
| 3,128,139 | 4/1964 | Estes | 174/35 SM X |
| 3,293,352 | 12/1966 | Livingston | 174/35 SM |
| 3,738,345 | 6/1973 | Gumtow | 123/198 R X |
| 3,792,694 | 2/1974 | Brenholts | 123/169 PH X |

FOREIGN PATENT DOCUMENTS

| | | | |
|---|---|---|---|
| 997,645 | 7/1965 | United Kingdom | 174/5 SG |

*Primary Examiner*—Charles J. Myhre
*Assistant Examiner*—Ira S. Lazarus
*Attorney, Agent, or Firm*—William C. Babcock

[57] ABSTRACT

A portable, light weight device that includes an electrical conducting grid or screen that may be grasped by a thumb and fore finger and deformed to partially or wholly encircle a spark plug wire and terminal associated therewith. The electrical conducting screen or grid has a pliable electrical conductor connected thereto, which conductor on the free end is provided with a clip to removably secure the clip to a ground portion of a vehicle. When the screen or grid is in engagement with a spark plug wire and terminal, the high tension wire may be removed from a spark plug by a bare hand of a user of the invention without receiving an electric shock.

2 Claims, 3 Drawing Figures

AUTOMOTIVE IGNITION TOOL

BACKGROUND OF THE INVENTION

1. Field of the Invention

Spark Shield.

2. Description of the Prior Art

In the maintenance and servicing of internal combustion engines, it is frequently desirable to remove a high tension conductor from the spark plug to which it extends. Normally such an operation can only be accomplished when the engine is not operating, or by the use of a hand tool havng an insulated handle, without receiving a substantial electric shock.

A major object of the present invention is to supply a light weight portable accessory that permits a high tension conductor to be disconnected from a spark plug while the engine is operating and without receiving an electric shock.

Another object of the invention is to provide a non-electrically insulated device that includes a deformable electrical conducting grid that may be easily engaged by a thumb and forefinger of a user, and when so engaged brought into contact with a high tension conductor and terminal thereof, to ground the latter and permit a high tension conductor to be removed from a spark plug while the engine is operating and without the user receiving an electric shock.

SUMMARY OF THE INVENTION

A portable light weight device that includes an electrical conducting screen that may be grasped by a user and brought into contact with the terminal of a high tension line extending to a spark plug. The screen has a pliable electrical conductor extending therefrom to a clip that is removably secured to a grounded portion of an automotive vehicle. When the screen is in engagement as above described, the high tension conductor may be removed from engagement with a spark plug without the user receiving an electric shock. After the invention has served its intended purpose, it is removed from the vehicle, and may be formed into a compact configuration to be stored in a minimum of space or carried in a user's pocket for future use.

DESCRIPTION OF THE PREFERRED EMBODIMENT

Figure 1:
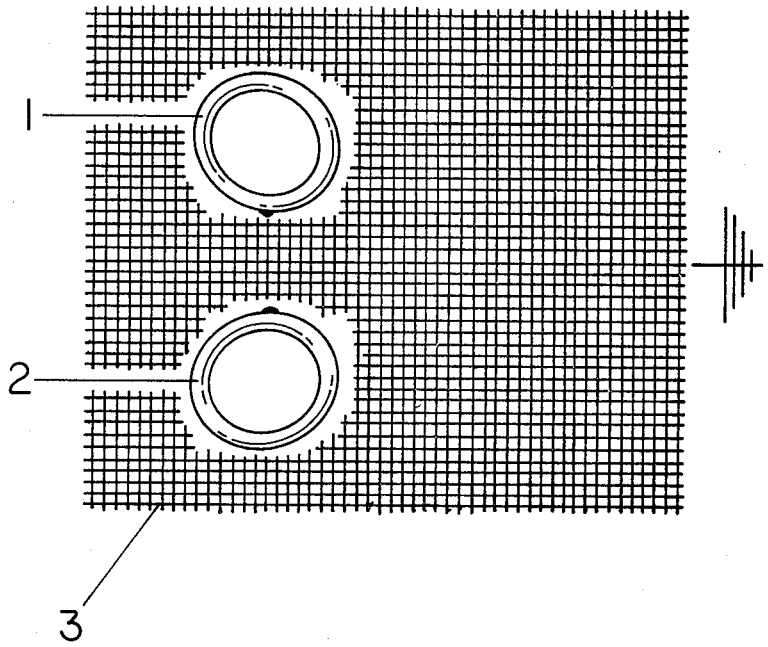
FIG. 1 is a top plan view of the invention.
Figure 2:
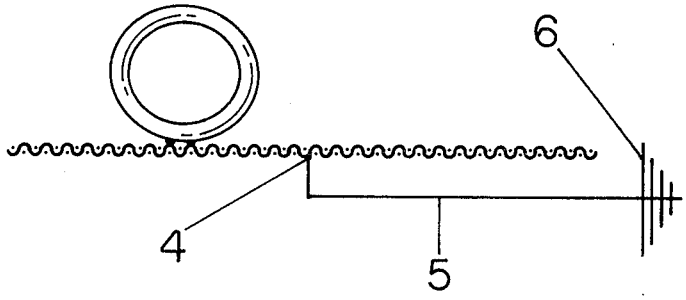
FIG. 2 is a side elevational view of the invention.
Figure 3:
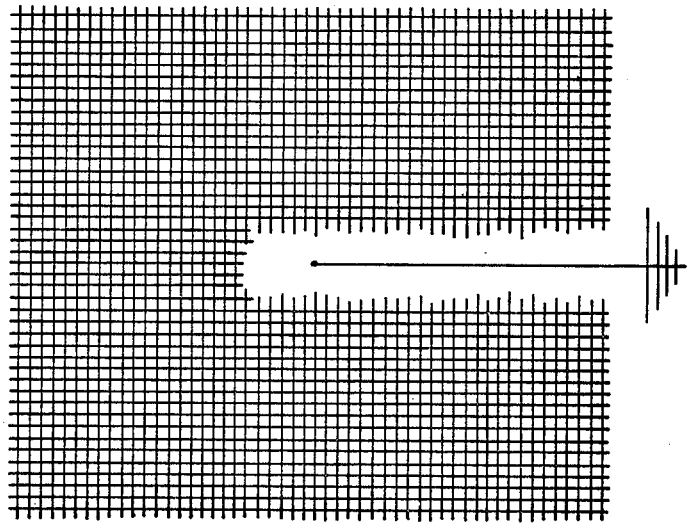
FIG. 3 is a bottom plan view of the invention.

The invention includes first and second rings 1 and 2 that may be removably engaged by the forefinger and thumb of a user, which rings are permanently secured by conventional means to spaced openings in a relatively small sheet 3 of an electrical conducting metallic pliable screen or grid. The sheet 3 may be square and have sides that range between 4 to 6 inches in length.

A pliable electrical conductor 5 is connected by a drop of solder 4 to the screen 3. A free end of the conductor 5 has a conventional spring-loaded clip 6 secured thereto, which clip may be removably secured to a grounded portion of an automotive vehicle.

The invention is used by a forefinger and thumb of a user engaging rings 1 and 2 and the screen 3 then deformed to engage a terminal of a high tension line of an internal combustion engine that is operating. The terminal is now grounded and the high tension line may be separated from the spark plug without the user receiving an electric shock. The appearance of the screen 3 is improved by being encased in a light film of plastic, which plastic permits high tension voltage to pass therethrough, and be grounded by conductor 5 and clip 6.

The use and operation of the invention has been previously described in detail and need not be repeated.

I claim:

1. In combination with an internal combustion engine powered vehicle having a plurality of spark plugs, a plurality of high tension voltage conductors that include terminals secured to said spark plugs, and a grounded portion, a device for removing a desired one of said conductors from a spark plug by a user without said user receiving an electric shock, said device including:

a. a pliable metallic screen having first and second spaced openings therein in which a forefinger and thumb of said user may be inserted to deform said screen into contact with one of said terminals to permit said conductor of which it forms a part to be separated from a spark plug when said internal combustion engine is operating;

b. A pliable electrical conductor secured to said screen; and c. A metallic clip on a free end of said conductor that is secured to said grounded portion, with said high tension voltage conductor being removable from said plug when said engine is operating without said user receiving a shock due to said voltage flowing to said grounded portion rather to said user.

2. A device as defined in claim 1 in which said first and second openings are defined by first and second rings permanently secured to said screen.

* * * * *